US011129488B1

(12) United States Patent
Clyburn

(10) Patent No.: US 11,129,488 B1
(45) Date of Patent: Sep. 28, 2021

(54) SINGLE-SERVING COMMUNION CONTAINER

(71) Applicant: Michael Clyburn, New Haven, CT (US)

(72) Inventor: Michael Clyburn, New Haven, CT (US)

( * ) Notice: Subject to any disclaimer, the term of this patent is extended or adjusted under 35 U.S.C. 154(b) by 246 days.

(21) Appl. No.: 16/451,240

(22) Filed: Jun. 25, 2019

(51) Int. Cl.
*A47G 33/00* (2006.01)
*B65D 51/28* (2006.01)
*B65B 5/04* (2006.01)

(52) U.S. Cl.
CPC ..... *A47G 33/002* (2013.01); *B65B 5/04* (2013.01); *B65D 51/28* (2013.01)

(58) Field of Classification Search
CPC .. A47G 33/002; A47G 19/2205; A47G 19/22; A47G 33/00; A47G 33/006; A47G 33/008; B65D 51/28; B65B 5/04; A45F 3/16
USPC ..... 206/217, 457, 19; 220/568, 592.17, 220/62.14, 737
See application file for complete search history.

(56) References Cited

U.S. PATENT DOCUMENTS 3,514,029 A * 5/1970 Powell ..... A47G 33/002 206/223
4,923,702 A * 5/1990 Powell ..... A47G 19/2205 206/19
5,246,106 A 9/1993 Johnson
5,584,388 A 12/1996 Johnson
D400,093 S 10/1998 Israelsson
6,022,570 A * 2/2000 Richmond ..... A45F 3/18 206/19
6,308,859 B1 * 10/2001 Johnson ..... A47G 33/002 220/738
2002/0014428 A1 * 2/2002 Kim ..... G09F 1/12 206/423
2008/0283423 A1 * 11/2008 Williams ..... A47G 33/002 206/217
2010/0102096 A1 * 4/2010 Willows ..... A45F 5/00 224/148.1
2011/0248032 A1 * 10/2011 Simms ..... A47G 19/20 220/212
2012/0273373 A1 * 11/2012 Wu ..... A47G 19/2205 206/217
2013/0126686 A1 * 5/2013 Ballou ..... A47G 23/0225 248/205.2
2015/0122673 A1 5/2015 Loumbroukos
2018/0184832 A1 7/2018 Shaw

FOREIGN PATENT DOCUMENTS

WO 2015065853 5/2015

* cited by examiner

*Primary Examiner* — Rafael A Ortiz

(57) ABSTRACT

The single-serving communion container comprises a fluid container filled with grape juice. The fluid container may be cross-shaped and may be opened during a religious service so that the grape juice may be consumed. The single-serving communion container may further comprise a communion wafer that may be coupled, either directly or indirectly, to the fluid container. The single-serving communion container may further comprise a decorative holder. The decorative holder may be a figurine that holds the fluid container in a non-horizontal position. The figurine may represent a lamb where a leg of the lamb is lifted and wraps around the upright of the fluid container to hold the fluid container in position.

1 Claim, 3 Drawing Sheets

SINGLE-SERVING COMMUNION CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of ceremonial equipment, more specifically, a single-serving communion container.

Receiving communion may be difficult for disabled individuals, the elderly, and children due to mobility issues, weakness, and coordination issues. Even those who can participate fully may be concerned about sharing a chalice or the handling of the communion wafer by other individuals. Also, a chalice of wine and a communion wafer may not be convenient for administering communion to individual who must work or be on call during the religious service. Non-limiting examples of these groups of individuals may include police, firefighters, doctor, and nurses.

SUMMARY OF INVENTION

The single-serving communion container comprises a fluid container filled with grape juice. The fluid container may be cross-shaped and may be opened during a religious service so that the grape juice may be consumed. The single-serving communion container may further comprise a communion wafer that may be coupled, either directly or indirectly, to the fluid container. The single-serving communion container may further comprise a decorative holder. The decorative holder may be a figurine that holds the fluid container in a non-horizontal position. The figurine may represent a lamb where a leg of the lamb is lifted and wraps around the upright of the fluid container to hold the fluid container in position.

An object of the invention is to provide a single-serving of communion to an individual.

Another object of the invention is to provide a fluid container that may be filled with grape juice as a substitute for communion wine.

A further object of the invention is to provide a communion wafer and a protective wafer cover.

Yet another object of the invention is to provide a decorative holder for the fluid container and communion wafer.

These together with additional objects, features and advantages of the single-serving communion container will be readily apparent to those of ordinary skill in the art upon reading the following detailed description of the presently preferred, but nonetheless illustrative, embodiments when taken in conjunction with the accompanying drawings.

In this respect, before explaining the current embodiments of the single-serving communion container in detail, it is to be understood that the single-serving communion container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the single-serving communion container.

It is therefore important that the claims be regarded as including such equivalent construction insofar as they do not depart from the spirit and scope of the single-serving communion container. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
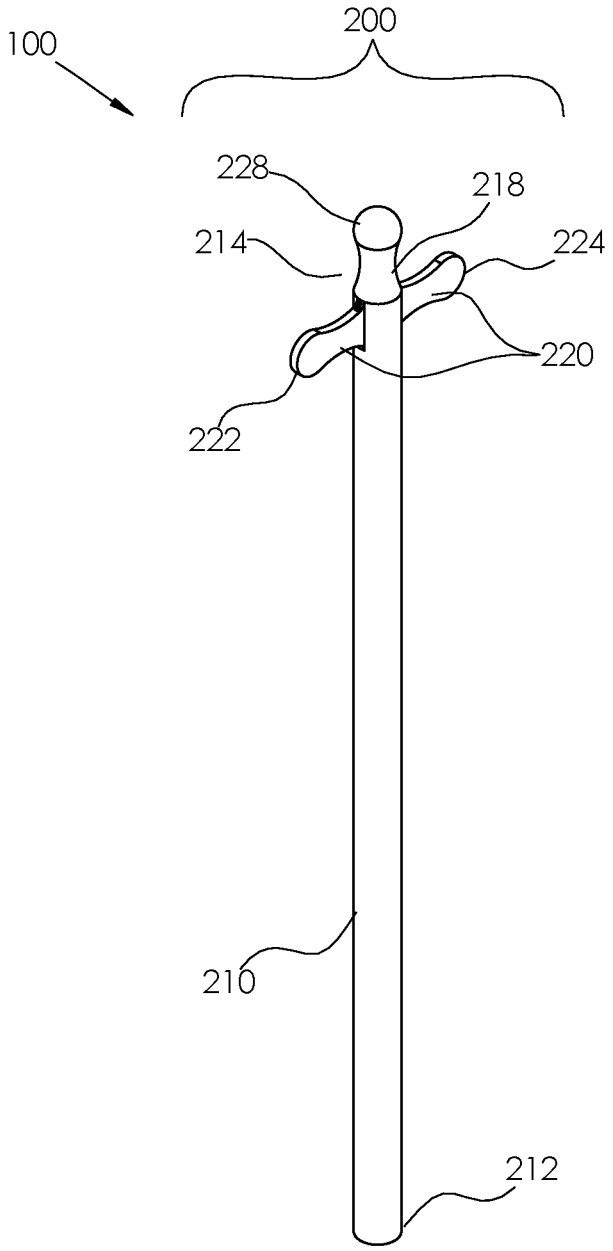
FIG. 1 is a perspective view of an embodiment of the disclosure illustrating the fluid container.
Figure 2:
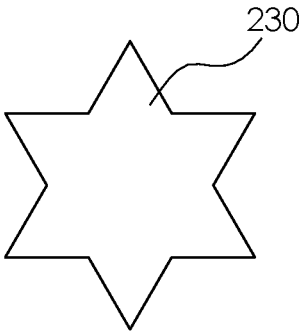
FIG. 2 is a top view of an embodiment of the disclosure illustrating the communion wafer.
Figure 3:
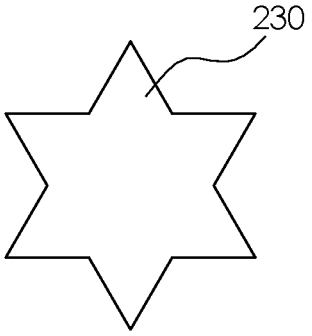
FIG. 3 is a bottom view of an embodiment of the disclosure illustrating the communion wafer.
Figure 4:
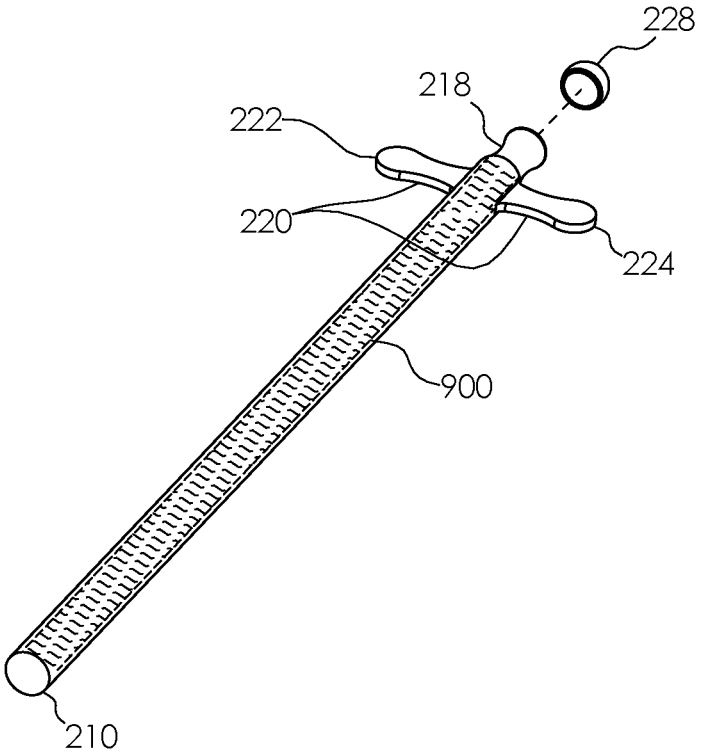
FIG. 4 is an exploded view of an embodiment of the disclosure illustrating the fluid container.
Figure 5:
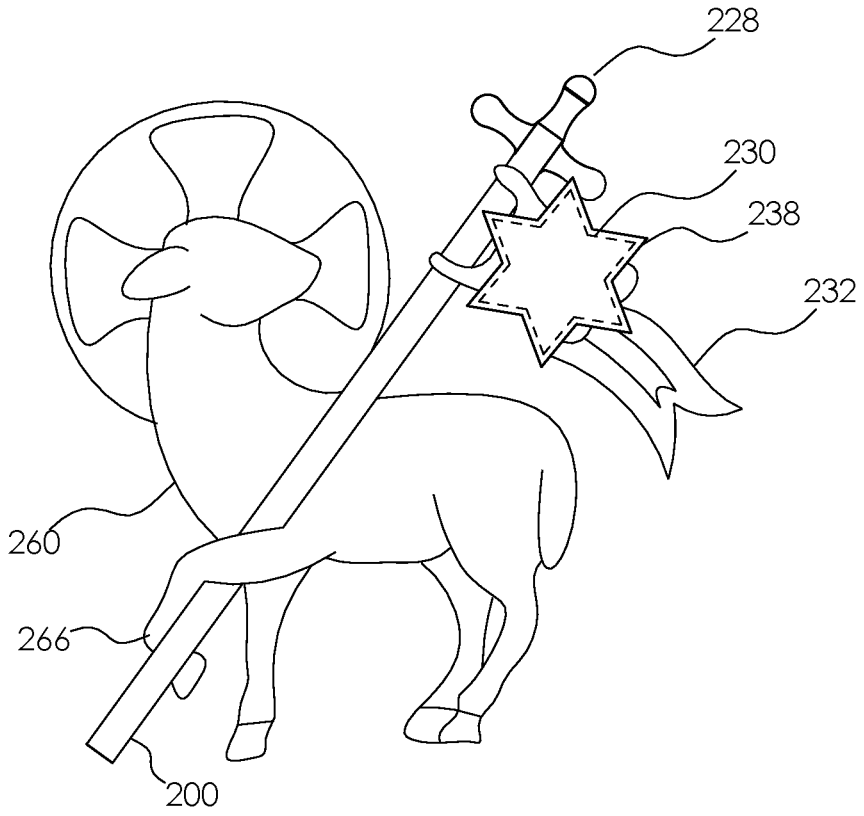
FIG. 5 is a front view of an embodiment of the disclosure illustrating the decorative holder, fluid container, banner, and communion wafer within the wafer cover.

Detailed reference will now be made to a first potential embodiment of the disclosure, which is illustrated in FIGS. 1 through 5.

The single-serving communion container 100 (hereinafter invention) comprises a fluid container 200. The fluid container 200 may be filled with grape juice 900. The fluid container 200 may be cross-shaped. The fluid container 200 may be opened during a religious service such that the grape juice 900 may be consumed.

The fluid container 200 may comprise an upright 210, a cross bar 220, and a seal 228. The upright 210 may store the grape juice 900 until the grape juice 900 is consumed.

The upright 210 may be a hollow tube that is rigid or semi-rigid. A bottom 212 of the upright 210 may be closed so that the grape juice 900 does not exit the upright 210 through the bottom 212. A top 214 of the upright 210 may be sealed by the seal 228 to retain the grape juice 900 within the upright 210. In some embodiments, an upper end of the upright 210 may be contoured to form a mouthpiece 218.

The cross bar 220 may be one or more armatures that couple to the upright 210. The cross bar 220 may be oriented to be perpendicular to the upright 210. The cross bar 220 may extend an equal distance in opposite sides of the upright 210. The length of the cross bar 220, as measured from a left end 222 of the cross bar 220 to a right end 224 of the cross bar 220, may be less than or equal to the length of the upright 210, as measured from the top 214 to the bottom 212. The coupling between the cross bar 220 and the upright 210 may maintain the watertight seal that retains the grape juice 900 within the upright 210.

The seal 228 may be a detachable covering coupled to the top 214 of the upright 210. As non-limiting examples, the seal 228 may detach from the upright 210 when twisted, pulled, or snapped.

The invention 100 may further comprise a communion wafer 230. The communion wafer 230 may be a circular or non-circular disk of unleavened bread. In some embodiments, the communion wafer 230 may be the shape of a six-sided star.

In some embodiments, the communion wafer 230 may be encapsulated within a wafer cover 238. The wafer cover 238 may be an enclosure that protects the communion wafer 230 from contamination or breakage. As non-limiting examples, the wafer cover 238 may be made from plastic, cellophane, cardboard, paper, other food-safe packaging materials, or combinations thereof. The wafer cover 238 may be removed from the communion wafer 230 by peeling or separating the wafer cover 238 to reveal the communion wafer 230. The communion wafer 230 may be detachably coupled to the fluid container 200, either directly or indirectly. As a non-limiting example, a representation of a banner 232 may be coupled to the upright 210 of the fluid container 200 such that the banner 232 appears to be flying from the upright 210 and the communion wafer 230 may be detachably coupled to the banner 232.

The invention 100 may further comprise a decorative holder 260. The decorative holder 260 may be a figurine that holds the fluid container 200 in a non-horizontal position. In embodiments where the communion wafer 230 is coupled to the fluid container 200, the decorative holder 260 may present both the fluid container 200 and the communion wafer 230 for use. In some embodiments, the figurine may represent a lamb where a leg 266 of the lamb is lifted and wraps around the upright 210 of the fluid container 200 to hold the fluid container 200 in position.

In use, the invention 100 may be presented to an individual as part of the religious service. In embodiments where the fluid container 200 is held in the decorative holder 260, a communicant, a celebrant, or another designated individual may remove the fluid container 200 from the decorative holder 260.

In embodiments that include the communion wafer 230, the communicant may detach the communion wafer 230 from the fluid container 200, remove the wafer cover 238 from the communion wafer 230, and consume the communion wafer 230. The communicant may remove the seal 228 from the fluid container 200 and drink the grape juice 900 from the top 214 of the upright 210.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, the words "couple", "couples", "coupled" or "coupling", refer to connecting, either directly or indirectly, and does not necessarily imply a mechanical connection.

As used in this disclosure, "decorative" is an adjective that refers to a first object or item that is used with a second object or item of the purpose of making the second object or item more attractive. Decorative will generally, but not necessarily, imply making the second object or item more attractive visually.

As used herein, "food safe" refers to a material that does not contaminate food that it contacts.

As used in this disclosure, "horizontal" is a directional term that refers to a direction that is perpendicular to the local force of gravity. Unless specifically noted in this disclosure, the horizontal direction is always perpendicular to the vertical direction.

As used herein, "mouthpiece" refers to an element that is a designed to have lips placed against it.

As used in this disclosure, "resilient" or "semi-rigid" refer to an object or material which will deform when a force is applied to it and which will return to its original shape when the deforming force is removed.

As used herein, "rigid" refers to an object or material which is inflexible. If a force is applied to a rigid object the rigid object does not bend or deform unless the force applied reaches the breaking point of the rigid object.

As used herein, the word "watertight" refers to a barrier that is impermeable to water.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A single-serving communion container comprising:

a fluid container, and a communion wafer;

wherein the fluid container is filled with grape juice;

wherein the fluid container is cross-shaped;

wherein the fluid container is opened during a religious service such that the grape juice is consumed;

wherein the fluid container comprises an upright, a cross bar, and a seal;

wherein the upright stores the grape juice until the grape juice is consumed;

wherein the communion wafer is a circular or non-circular disk of unleavened bread;

wherein a representation of a banner is coupled to the upright of the fluid container such that the banner appears to be flying from the upright and the communion wafer is detachably coupled to the banner;

wherein the upright is a hollow tube that is rigid or semi-rigid;

wherein a bottom of the upright is closed so that the grape juice does not exit the upright through the bottom;

wherein a top of the upright is sealed by the seal to retain the grape juice within the upright;

wherein an upper end of the upright is contoured to form a mouthpiece;

wherein the cross bar is one or more armatures that couple to the upright;

wherein the cross bar is oriented to be perpendicular to the upright;

wherein the cross bar extends an equal distance in opposite sides of the upright;

wherein the length of the cross bar, as measured from a left end of the cross bar to a right end of the cross bar, is less than or equal to the length of the upright, as measured from the top to the bottom;

wherein the coupling between the cross bar and the upright maintains the watertight seal that retains the grape juice within the upright;

wherein the seal is a detachable covering coupled to the top of the upright;

wherein the seal detaches from the upright when twisted, pulled, or snapped;

wherein the communion wafer is the shape of a six-sided star;

wherein the communion wafer is encapsulated within a wafer cover;

wherein the wafer cover is an enclosure that protects the communion wafer from contamination or breakage;

wherein the wafer cover is removed from the communion wafer by peeling or separating the wafer cover to reveal the communion wafer;

wherein the communion wafer is detachably coupled to the fluid container, either directly or indirectly;

wherein a decorative holder is included, and is a figurine that holds the fluid container in a non-horizontal position;

wherein the figurine represents a lamb where a leg of the lamb is lifted and wraps around the upright of the fluid container to hold the fluid container in position.

* * * * *